United States Patent [19]

Poirier

[11] Patent Number: 4,821,910

[45] Date of Patent: Apr. 18, 1989

[54] CLOSURE AND CONTAINER HAVING TAMPER PROOF MEANS

[75] Inventor: Charles Poirier, St-Damien, Canada

[73] Assignee: IPL Inc, Quebec, Canada

[21] Appl. No.: 212,866

[22] Filed: Jun. 29, 1988

[51] Int. Cl.[4] ..... B65D 41/32

[52] U.S. Cl. ..... 220/266; 220/306

[58] Field of Search ..... 220/265, 266, 306; 215/253

[56] References Cited

U.S. PATENT DOCUMENTS

| | | | |
|---|---|---|---|
| 4,082,201 | 4/1978 | Bittel . | |
| 4,520,943 | 6/1985 | Nielsen . | |
| 4,610,371 | 9/1986 | Karkiewicz | 220/266 |
| 4,694,971 | 9/1987 | Elsmo et al. | 215/253 |
| 4,711,372 | 12/1987 | Gach | 220/266 |
| 4,763,732 | 8/1988 | Neal | 220/266 |

*Primary Examiner*—George T. Hall

*Attorney, Agent, or Firm*—Helfgott & Karas

[57] ABSTRACT

The disclosure herein describes the combination of a closure and a container where a frangible element is provided on the peripheral skirt portion of the closure to come into a locking engagement with the upper flange of the container. The element is made of frangible material so that it must be broken whenever the closure is removed from the container to thereby provide a visual indication of removal of the closure, whether authorized or unauthorized.

6 Claims, 3 Drawing Sheets

CLOSURE AND CONTAINER HAVING TAMPER PROOF MEANS

FIELD OF THE INVENTION

The present invention pertains to the combination of a closure and container of the type providing some indication when unauthorized opening of the closure has occurred.

BACKGROUND OF THE INVENTION

There are contents which, when enclosed in a closure-covered container, must not be tampered with and, whenever tampering has occurred, it is important that those authorized to remove the closure be aware that prior removal of the container has, in fact, occured.

OBJECTS AND STATEMENT OF THE INVENTION

It is therefore an object of the present invention to provide the combination of a closure and container that will provide a visual indication of removal of the closure, especially in cases of unauthorized opening.

This is achieved by providing, in the combination of the closure and container, a frangible element which will brake whenever the closure is removed, whether authorized or unauthorized.

The present invention therefore relates to such combination which comprises in its broadest aspect:

- a closure having a top wall and a peripheral depending skirt portion;
- a container having a side wall and an upper flange outwardly projecting from the side wall;
- cooperating means on the skirt portion and the flange to lock the closure to the container upon downward displacement of the closure onto the container;
- the cooperating means including a frangible element and locking means engageable with one another; the locking means including a hingeable portion adapted to be displaced by the frangible element as the closure is positioned onto the container, and to thereafter return to prevent the element from retraction from the locking means; the frangible element being breakable upon forceable removal of the closure from the container to thereby provide a visual indication of removal of the closure, whether authorized or unauthorized.

In one preferred form of the invention, the frangible element is located on the peripheral depending skirt portion of the top wall of the closure and is adapted to engage the locking means on an upper flange outwardly projecting from the side wall of the container.

In another form of the invention, the locking means consist of a pair of oppositely facing upstanding lugs; one of the lugs includes a base portion and an hingeable portion integrally connected to the base portion through a reduced material thickness providing the hinging effect. The other lug is contacted by the hingeable portion after having been downwardly displaced by the pin to prevent the retraction of the pin.

Other objects and further scope of applicability of the present invention will become apparent from the detailed description given hereinafter. It should Le understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
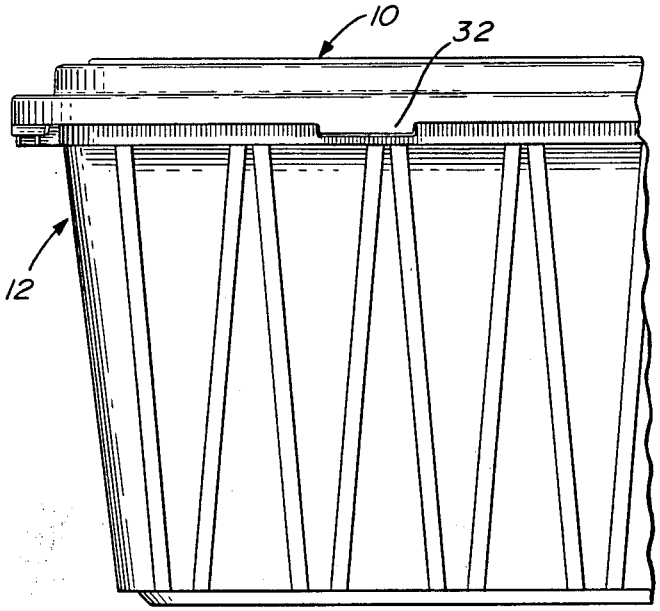
FIG. 1 is a fragmentary elevational view showing the combination of a closure and a container made in accordance with the present invention.
Figure 2:
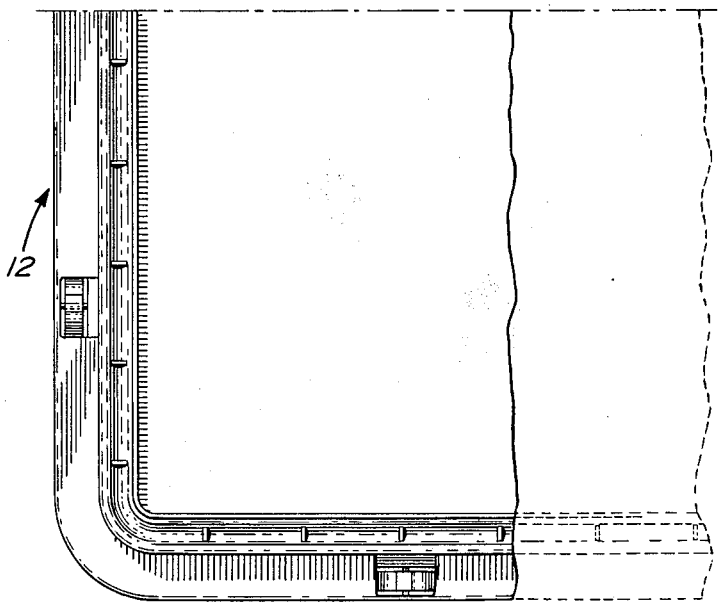
FIG. 2 is a bottom plan view of the combination shown in FIG. 1.
Figure 3:
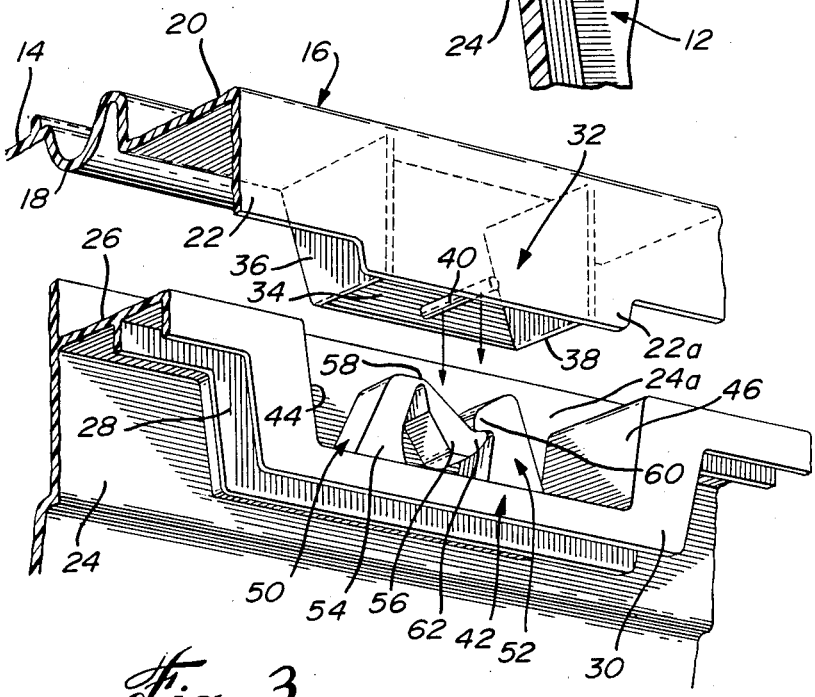
FIG. 3 is a fragmentary explosive perspective view of the closure and the container prior to engagement.

Referring to FIGS. 1, 2 and 3, there is shown a closure, generally denoted 10, and a container, generally denoted 12.

The closure 10 comprises a flat top wall 14 with a peripheral portion 16 that includes a U-shaped recessed portion 18, a flat horizontal portion 20 and a depending skirt portion 22.

The container 12 comprises a rectangular body having side walls 24, the upper ends of which display outwardly projecting flanges 26. Each flange include a reinforcing rib 28 extending therebeneath and a narrow depending outer skirt portion 30.

The closure 10 has a tamper-evident area, generally denoted 32, consisting of a slightly enlarged area **22*a* in the outer skirt portion 22. This area 22*a* covers a chamber defined by a rear wall 34 and two opposite side walls 36 and 38. In this chamber, transversely extends a frangible element 40, in the shape of a pin, which has its opposite ends respectively secured to the rear wall 34 and the interior side of the enlarged area 22*a* of skirt portion 22**.

The container 12 also includes a tamper-evident area 42 which cooperates with area 32 of the closure. Area 42 is defined by a recess formed by a wall area **42*a* of the side wall 24 of the container and two downwardly sloping walls 44 and 46. The distance separating walls 44 and 46 is slightly larger than the distance separating walls 36 and 38 of the closure so that the closure chamber, described above, may be received within the recess area 42**.

A pair of upstanding oppositely facing lugs 50 and 52 are integrally formed in area 42. Lug 50 comprises an enlarged base portion 54 and a hingeable portion 56 integral with the base portion through an area 58 of reduced thickness which serves as the hinge for the pivotal movement of portion 56 relative to portion 54. The opposite lug 52 has a construction somewhat similar to the enlarged base portion 54 but terminates, at its upper portion, with a lip 60 against which bears an extremity 62 of the hingeable portion 56. The resiliency of the material used for the container including the lugs allows the hingeable portion 56 to be upwardly biased.

Figure 4:
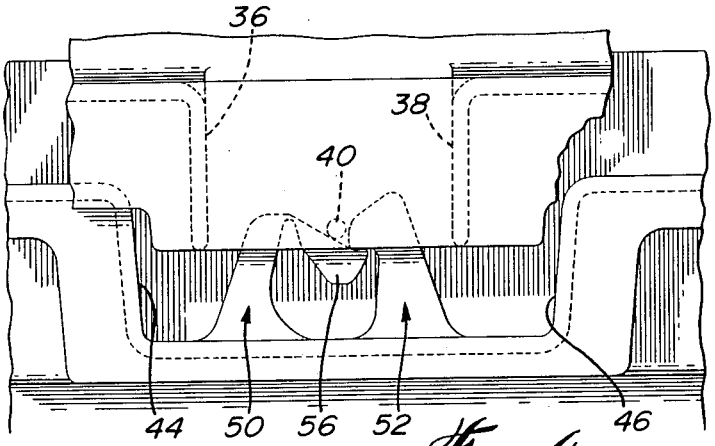
FIGS. 4, 5 and 6 are partial elevation views showing successive steps during engagement of the closure with the container.
Figure 5:
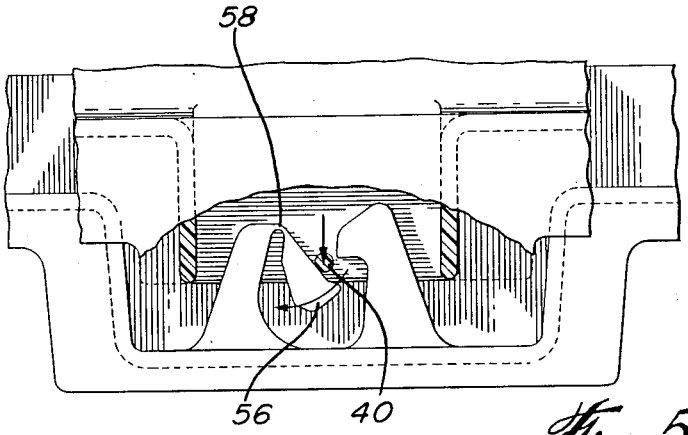
Figure 6:
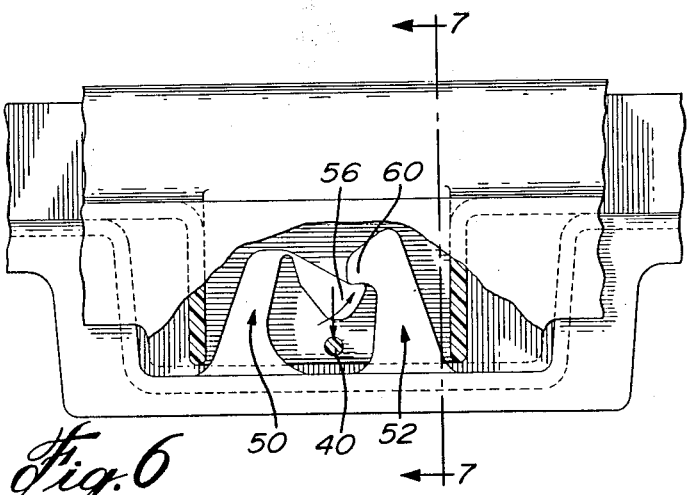

Referring to FIGS. 4, 5 and 6, the successive engagement steps of pin 40 with the pair of lugs is shown. In FIG. 4, pin 40 contacts the hingeable portion 56 as the closure is moved downward over the container, walls 36 and 38 respectively entering the free areas between lug 50 and wall 44 and between lug 52 and wall 46. FIG.

5 shows the pivotal movement of the hingeable portion 56 about the hinge area 58 of reduced thickness. In FIG. 6, the pin 40 is shown lowered in an enclosed area defined between the facing lugs 50 and 52 after the hingeable portion 56 has freed itself from contact with pin 40 and returned to contact lip 60 of lug 52. However, the shape of portion 56 is such that even if there is no contact with lip 60, any upward movement of the pin can only result in moving portion 56 against the lip thereby still preventing retraction of pin 40 from the enclosed area between the lugs.

Figure 7:
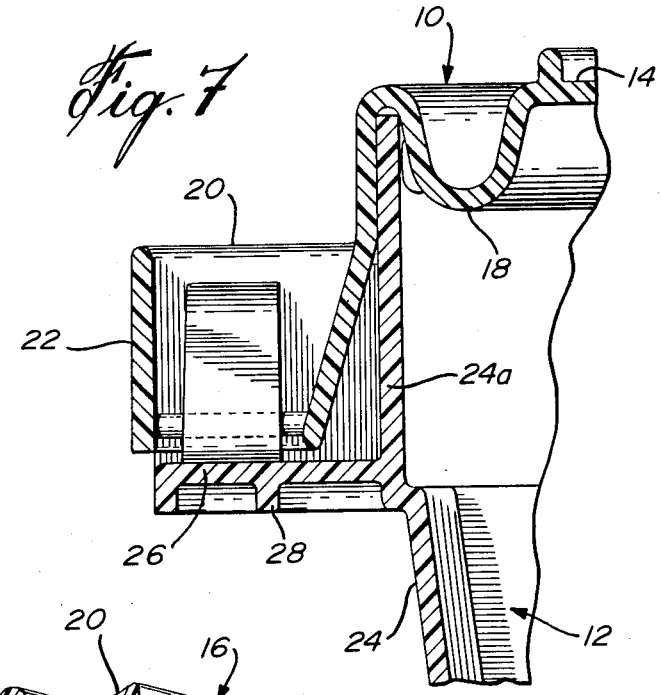
FIG. 7 is a cross-sectional view taken along lines 7—7 of FIG. 6.

Referring to FIG. 7, a secure engagement of the container 12 with the closure 10 is maintained by a squeezing action of the U-shaped area 18 of the top wall with the upper extremity 24*a* of the container side wall.

The pin 40 is made relatively thin and of a frangible material so that to open the closure, the pin must be broken. In a preferred form, the container and the closure are made of injection molded plastic material so that all of the above-described components of the closure and container are of the same material. However, the dimension (i.e. the diameter) of the pin must be such as to allow to brake prior to causing any damage to lugs 50 and 52. Therefore, any removal of the closure from the container must be made in a forceable manner so as to break the pin.

Chamber 32 in which pin 40 extends transversely must be confined to receive the pair of lugs therewithin while, at the same time, prevent any tampering with the operation of the hingeable portion 56 from outside. Therefore, the front enlarged area 22*a* of the skirt portion 22 is such as to completely close the recessed area to avoid any possibility of tampering inside to maneuver the hingeable portion 56 of lug 50.

Although the invention has been described above in relation to one specific form, it will be evident to the person skilled in the art that it may be refined and modified in various ways. For example, the closure and container need not be rectangular in shape; the present invention could be made possible on a container of circular cross-section. Also, the peripheral portions of the closure and container could be modified to provide a recess on the peripheral portion of the closure and a pin-receiving area on the flange portion of the container. It is therefore wished to have it understood that the present invention should not be limited in interpretation except by the terms of the following claims.

I claim:

1. In combination, a closure and a container;

said closure having a top wall and a peripheral depending skirt portion; and at least one frangible element on the interior side of said skirt portion;

said container having a side wall and an upper flange outwardly projecting from said side wall; said flange displaying a recessed area adapted to receive said frangible element therein;

locking means in said area including a hingeable portion adapted to be downwardly displaced by said frangible element, as said closure is positioned onto said container, and to thereafter upwardly return to block said element from retraction from said recessed area;

said frangible element being brakeable upon forcible removal of said closure from said container to thereby provide a visual indication of removal of the closure, whether authorized or unauthorized.

2. In combination, a closure and a container;

said closure having a rectangular top wall and a peripheral depending skirt portion on each side wall thereof; at least one frangible element disposed on the interior side of each said skirt portion;

said container having a rectangular body with side walls and an upper flange outwardly projecting from each side wall; each said flange displaying a recessed area adapted to receive an associated frangible element therein;

locking means in said area including an hingeable portion adapted to be downwardly displaced by said frangible element, as said closure is positioned onto said container, and to thereafter upwardly return to block said element from retraction from said area;

said frangible element being breakable upon forcible removal of said closure from said container to thereby provide a visual indication of removal of the closure, whether authorized or unauthorized.

3. A combination as defined in claim 1 or 2, wherein said locking means consist of a pair of oppositely facing upstanding lugs, one of said lugs including a base portion; said hingeable portion being integrally connected to said base portion through reduced material thickness; the other of said lugs having a portion contacting said hingeable portion.

4. A combination as defined in claim 1 or 2, wherein said frangible element consists of a pin extending transversely in a chamber defined by the interior side of said skirt portion and a rear wall downwardly extending under said top wall of said closure inwardly of said skirt portion; said rear wall and said interior side of said skirt portion securing the opposite ends of said pin.

5. A combination as defined in claim 1 or 2, wherein said container and said closure are made of plastic material; said pin being integral with said closure and said lugs being integral with said container.

6. In combination, a closure having a top wall and a peripheral depending skirt portion;

a container having a side wall and an upper flange outwardly projecting from said side wall;

cooperating means on said skirt portion and said flange to lock said closure to said container upon downward displacement of said closure onto said container;

said cooperating means including a frangible element and locking means engageable with one another; said locking means including a hingeable portion adapted to be displaced by said frangible element as said closure is positioned onto said container, and to thereafter return to lock said element from retraction from said locking means; said frangible element being breakable upon forceable removal of the closure from the container to thereby provide a visual indication of removal of the closure, whether authorized or unauthorized.

* * * * *